United States Patent [19]

Bantz et al.

[11] 4,111,256

[45] Sep. 5, 1978

[54] LADLE GATE

[75] Inventors: Paul Edward Bantz, Waukesha; Robert William Mayer, Milwaukee, both of Wis.

[73] Assignee: Globe-Union Inc., Milwaukee, Wis.

[21] Appl. No.: 784,253

[22] Filed: Apr. 4, 1977

[51] Int. Cl.[2] ..... B22D 41/00

[52] U.S. Cl. ..... 164/335; 164/438; 249/105

[58] Field of Search ..... 164/335, 437, 438, 136, 164/337, 155; 249/105

[56] References Cited

U.S. PATENT DOCUMENTS

| | | | |
|---|---|---|---|
| 729,752 | 6/1903 | Gates | 164/335 X |
| 729,755 | 6/1903 | Gates | 164/335 X |
| 1,034,970 | 8/1912 | Brown, Jr. | 164/335 |
| 1,138,443 | 5/1915 | Bierbaum | 164/136 X |

FOREIGN PATENT DOCUMENTS

| | | | |
|---|---|---|---|
| 499,018 | 3/1974 | Japan | 164/335 |

*Primary Examiner*—Robert L. Spicer, Jr.
*Attorney, Agent, or Firm*—David B. Smith; John Phillip Ryan

[57] ABSTRACT

A ladle gate for use with casting apparatus including a mold of the kind used in casting battery plate grids and including a ladle of the type used in holding a supply of molten lead alloy and being pivotable into a pouring position wherein a quantity of the molten lead alloy can be poured into the mold. The ladle gate is positioned adjacent the ladle spouts and functions to permit flow of molten lead alloy through the ladle spouts when the ladle is in a pour position, and to interrupt the flow of molten lead alloy through the spouts at the completion of the pour, when the ladle pivots to its rest position, to thereby prevent the formation of solidified drippage at the spouts.

5 Claims, 8 Drawing Figures

LADLE GATE

BACKGROUND OF THE INVENTION

1. Field of the Invention

The present invention relates to apparatus used in pouring molten metals in casting applications, and more particularly, to a ladle gate for use with a ladle to control flow of molten metal, such as lead alloy, from the ladle and to prevent the formation of solidified drippage adjacent the ladle spouts.

2. Description of the Prior Art

In the molding of articles such as battery plates or grids, molten lead or lead alloy is poured into a mold having a narrow, generally planar mold cavity. The mold is generally positioned beneath a ladle which comprises an elongated trough-like structure and which includes a generally vertical front wall having a plurality of ports or pouring spouts extending along its length in horizontal alignment. The ladle is supported for pivotable movement about a longitudinal horizontal axis oriented such that the ladle can pivot forwardly and molten lead alloy can pour through the spouts into the mold. Molten lead alloy is supplied to the ladle such that when the ladle is in the static position, the level of the molten lead is maintained at a level slightly below the spouts and when the ladle pivots forwardly about its horizontal axis, the molten lead will then flow through the spouts.

Conventional lead alloys containing such additives as antimony, for example, have been used successfully with such apparatus and without difficulty. The formation of drippage or solidified lead at the lips of the spouts at the completion of each pouring cycle is controlled by directing gas flames at the spouts along the length of the ladle. However, lead alloys which have been used more recently in forming battery grids and which contain material such as strontium, have presented molding difficulties, in that, during the termination of the pouring cycles, as the flow of lead alloy through the ports ceases, some of the lead alloy tends to solidify and form drippage at the ladle spouts, and conventional means of controlling such solidified drippage is ineffective. The presence of such drippage is unacceptable since it may fall into an open mold thereby either preventing the mold from closing or contaminating the next article molded.

SUMMARY OF THE INVENTION

The present invention includes a ladle gate for use in combination with casting apparatus including a mold and ladle, the ladle gate being effective to prevent the formation of such drippage at the ladle spouts and thus facilitating casting of battery grids which are comprised of the newly developed and more advantageous lead alloys.

The ladle gate includes an elongated gate bar which is resiliently supported against the vertical front wall of the ladle adjacent the ladle spouts and which interrupts the flow of molten metal through the spouts as the ladle moves from its pouring position to its rest position, thereby preventing the formation or accumulation of solidified lead alloy adjacent the spouts.

Other advantages of the ladle gate will be seen from the following description of the preferred embodiment. The following description is intended to set forth only two preferred embodiments of the invention and should not be taken as limiting the scope of the invention other than as set forth in the claims.

DESCRIPTION OF THE PREFERRED EMBODIMENTS

Figure 1:
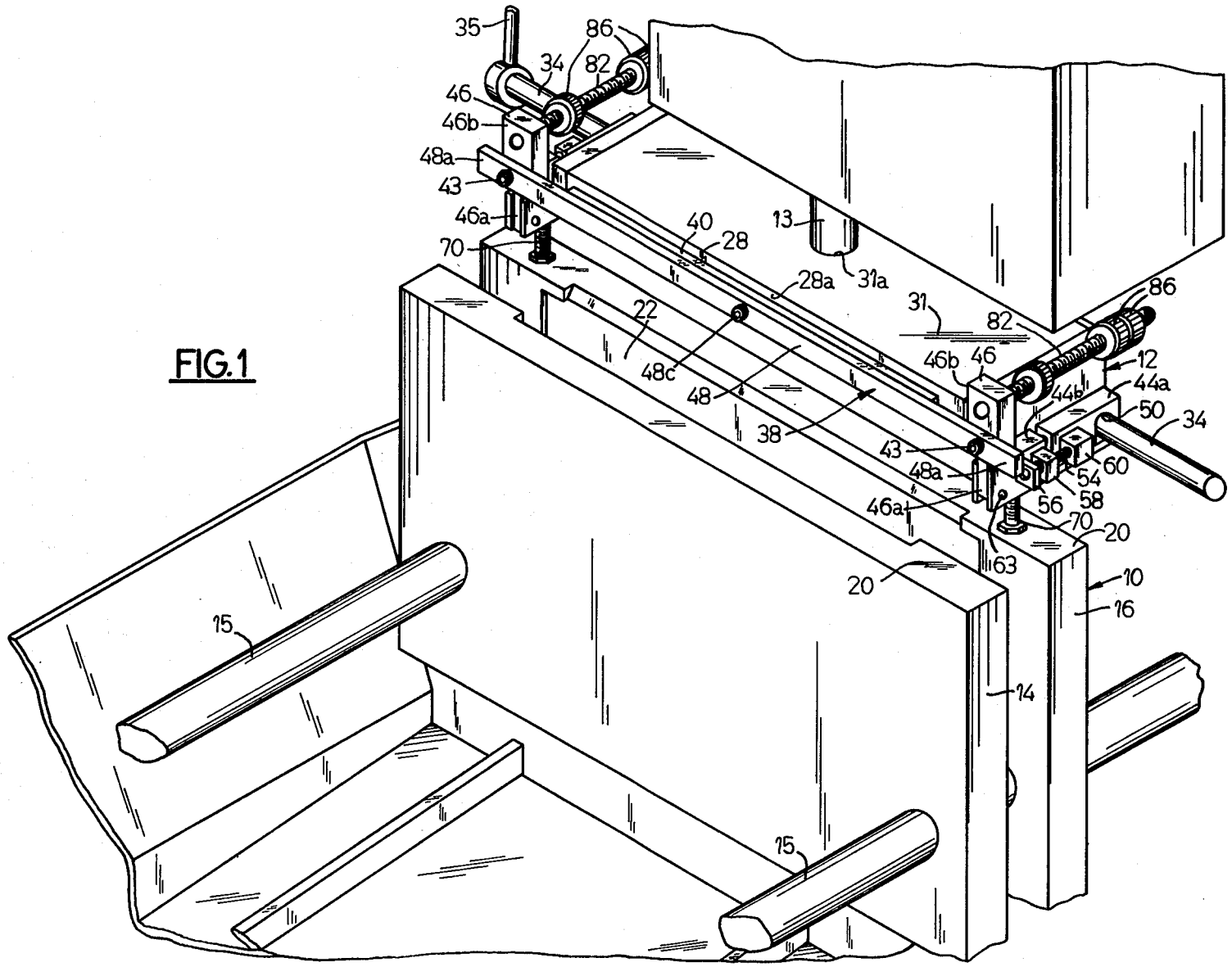
FIG. 1 is a perspective view of a battery plate casting apparatus including a ladle and ladle gate.
Figure 2:
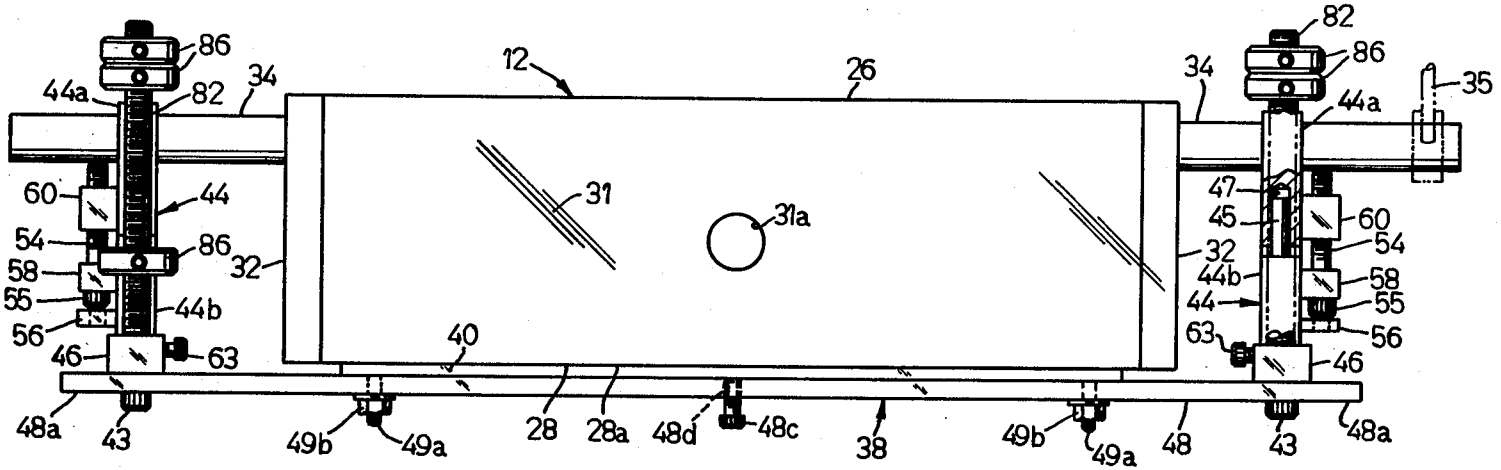
FIG. 2 is an enlarged plan view of the ladle and ladle gate shown in FIG. 1.
Figure 3:
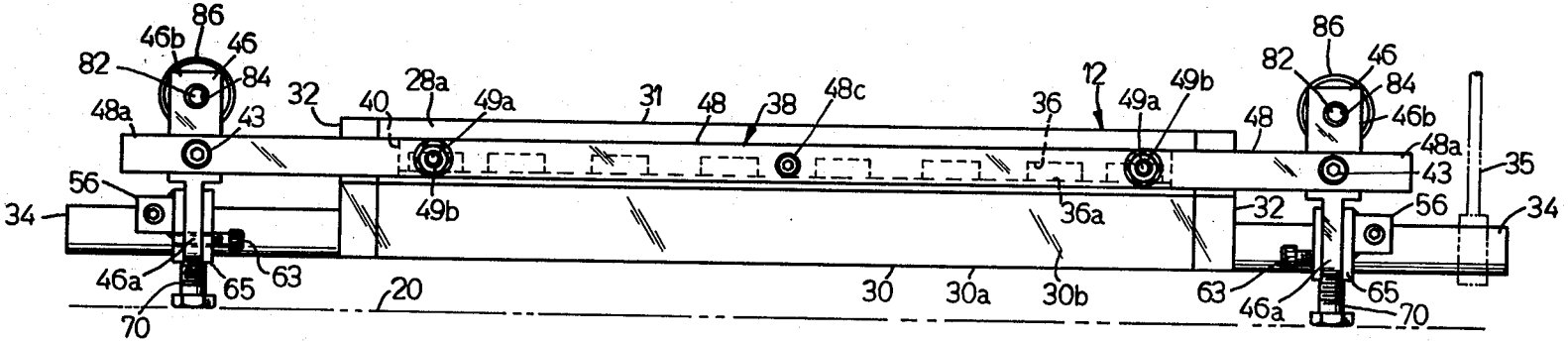
FIG. 3 is a front elevation view of the ladle and ladle gate shown in FIG. 2.

A battery plate casting apparatus is shown in FIG. 1 as including a battery plate mold 10, and a ladle 12 positioned above the mold 10 for pouring a molten lead alloy into the mold 10. The ladle 12 generally comprises a container for holding molten lead alloy, supplied to the ladle 12 from a supply source through conduit 13, and for pouring the molten lead alloy into the mold 10. The mold 10, illustrated in FIG. 1 is merely an example of a conventional mold commonly used with a ladle such as ladle 12 and is shown as being comprised of a pair of generally flat, vertically positioned mold halves 14 and 16. The mold halves 14 and 16 are supported by the support rods 15 and are relatively moveable between an open position (FIG. 1) and a closed position (not shown). The mold halves 14 and 16 each include a generally horizontal flat upper surface 20, and in the closed position the mold halves define a narrow generally planar battery plate mold cavity 22 therebetween and a gate between the upper surface 20 to facilitate pouring of molten metal from ladle 12 into the mold cavity. A conventional clamping mechanism (not shown) is operable to cause cyclical movement of the mold halves 14 and 16 between the open position and the closed position during each casting operation.

During the casting operation, molten lead alloy is poured from the ladle 12 into the cavity 22 in the mold 10, and the molten lead alloy is allowed to solidify in the mold cavity. The mold halves 14 and 16 then separate whereupon the molded battery grids drop out of the mold cavity to be received by a conventional conveying mechanism positioned below the mold.

The structure of the ladle 12 is shown more clearly in FIGS. 2–6. The ladle 12 is comprised of an elongated generally shallow trough or container 24 constructed for holding a quantity of molten lead or lead alloy. The ladle includes an elongated vertical rear wall 26, a front wall 28, having an elongated outer surface **28*a*, and a bottom wall 30 comprised of a generally horizontal portion 30*a* and an adjacent forwardly and upwardly sloping portion 30*b* joining the portion 30*a* and front wall 28. The ladle also includes a planar cover 31 having a central hole 31*a* therein for receiving the conduit 13 and further includes vertical end walls 32 each supported by a rigidly attached perpendicularly extending horizontal support shaft or trunnion 34. The support shafts 34 are axially aligned and are intended to support the ladle 12 for pivotal movement about the axis A of shafts 34 such that the ladle 12 can pivot about a horizontal axis between the rest position shown in FIG. 4 and the pour position shown in FIG. 5**.

Figure 4:
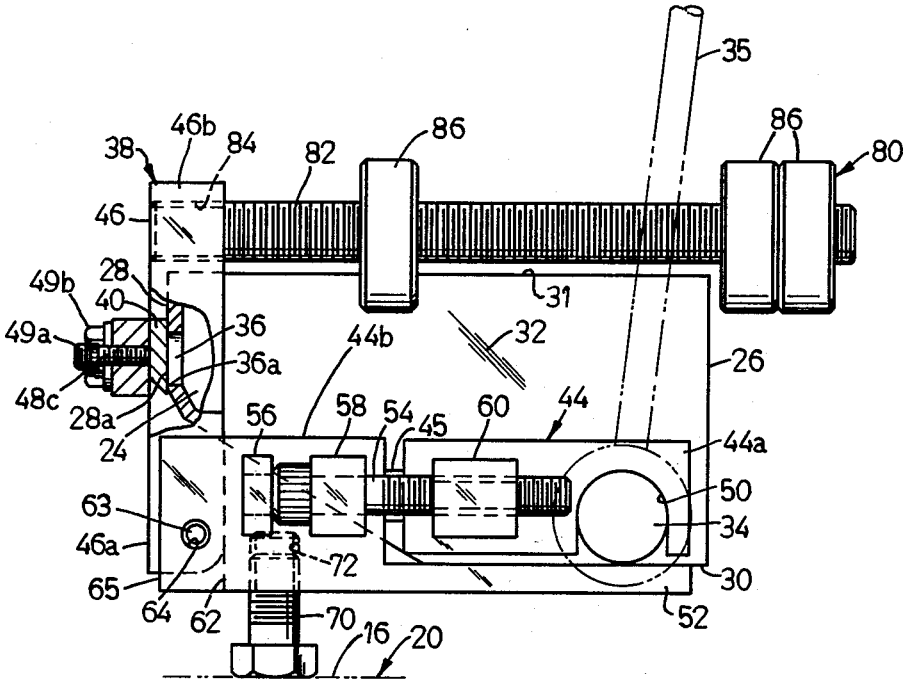
FIG. 4 is an enlarged end elevation view of the ladle and ladle gate shown in FIG. 2 with portions broken away in the interest of clarity.
Figure 5:
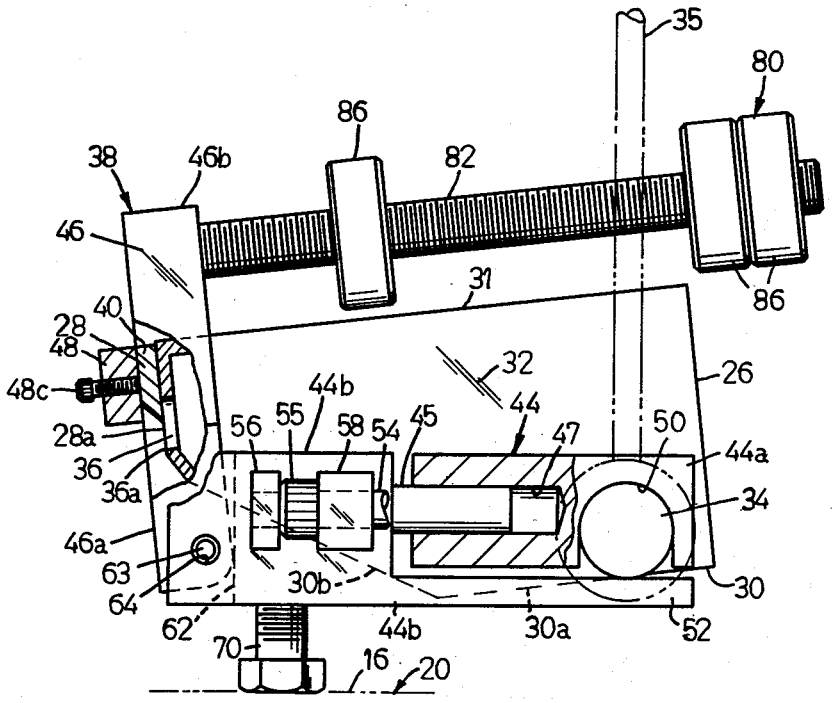
FIG. 5 is a view similar to FIG. 4 but illustrating the ladle and ladle gate in a pouring position.
Figure 6:
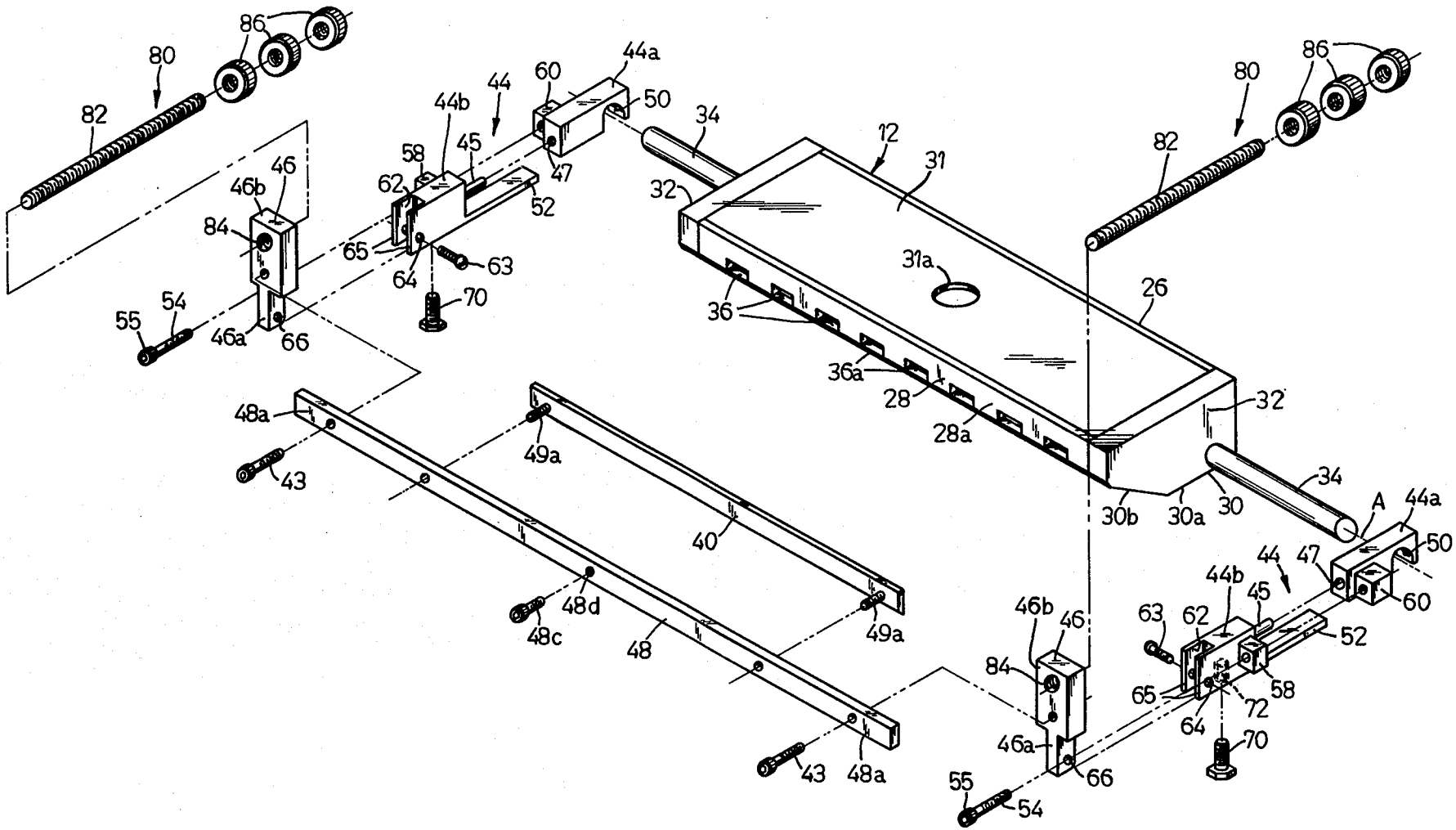
FIG. 6 is an exploded perspective view of the ladle and ladle gate shown in FIGS. 2–5.

The front wall 28 includes a plurality of generally rectangular, horizontally and linearly aligned openings or spouts 36, whereby when the ladle pivots about the axis A of shafts 34 from the position shown in FIG. 4 to the position shown in FIG. 5, molten lead can be poured through the spouts 36 into the mold 10.

The apparatus used for pivoting the ladle 12 between the rest and pour positions illustrated is well known and can comprise, for example, a lever 35 rigidly attached to one of the shafts 34 whereby the shaft 34 and the ladle 12 can be caused to rotate about axis A. Referring to FIGS. 4 and 5, it is shown that the shafts 34 are positioned in closely adjacent relationship to the rear wall 26 of the ladle 12 and the axis A of the shafts 34 is thus positioned rearwardly and below the spouts 36, such that when the ladle is caused to pivot about axis A from the rest or storage position to the pouring position, the front wall 28 and spouts 36 move generally downwardly and forwardly.

Ladle Gate

In order to prevent the formation of solidified drippage or residue at the edge or lip 36*a* of the spouts 36 at the completion of each pouring cycle, a ladle gate 38 is provided. The ladle gate 38 generally includes an elongated gate bar 40 resiliently held in flush engagement against the planar surface 28*a* of the front wall 28. The ladle gate 38 is restrained against vertical movement such that during pivotal movement of the ladle 12 between the pouring position shown in FIG. 5 and the rest position shown in FIG. 4, the spouts 36 and front wall 28 will move generally vertically upwardly with respect to the gate bar 40 whereby the gate bar 40 will slide against the planar surface 28*a* and will function to cut off the flow of molten lead alloy through the spouts 36.

More specifically, the ladle gate 38 is comprised of a pair of support arms 44 each having one end supported by the shafts 34 and an opposite end supported by the mold half 16. The support arms 44 in turn support vertical member 46. The vertical members 46 are pivotably supported at their lower ends 46*a* for pivotal movement about a horizontal axis parallel to the axis A and are intended to function to support the opposite ends 48*a* of an elongated horizontal support bar 48. The elongated support bar 48 is secured to the respective spaced apart support members 46 by screws 43. The support bar 48 is spaced from and is supported in parallel relation to the front wall 28 and in turn supports the elongated gate bar 40 against the front wall 28. The gate bar 40 is secured to the support bar 48 by bolts 49*a* and nuts 49*b*. Since the ladle 12 is intended to hold a molten metal, the various parts of the ladle gate 38 are subjected to substantial heat. In order to compensate for the potential tendency of the elongate gate bar 40 to warp as a result of subjection to heat, an adjustment screw 48*c* is provided. The adjustment screw 48*c* is threadably received in a threaded bore 48*d* in the support bar 48 and is functional to prevent bowing of the gate bar 40 to insure that it is held in flush relation against the planar surface 28*a* of the front wall 28 along its entire length.

The support arms 44 are each comprised of a pair of telescoping sections 44*a* and 44*b*, section 44*a* including a longitudinal bore 47 and projecting rod 45 functional to permit adjustment of the length of the support arms 44, i.e. adjustable movement of the telescoping section 44*b* and the elongated gate bar 40 in a direction perpendicular to the planar surface 28*a* of the front wall 28. In order to facilitate such adjustment of the relative length of the support arms 44, the telescoping sections 44*a* and 44*b* are joined by a bolt 54, positioned parallel to the axis of the projecting rod 45. The head 55 of the bolt 54 is supported between a pair of brackets 56 and 58 welded to the section 44*b*, and the opposite end of the bolt is threadably received within a nut 60 welded to the section 44*a* whereby rotation of the bolt will result in movement of the sections 44*a* and 44*b* toward or away from each other.

The telescoping section 44*a* includes a notch 50 in one end, the notch 50 having a concave end for receiving the shaft 34 therein. Section 44*b* includes a rearwardly extending projection 52 received beneath the section 44*a* and shaft 34 for maintaining the shaft 34 in the slot 50. The support arms 44 are thus supported by the shafts 34 but are not secured to the shafts 34 and are free to rotate with respect to the shafts. The forwardly extending ends of telescoping sections 44*b* of the support arms 44 are each supported by bolts 70 each threadably received in a vertical bore 72 in one of the support arms 44. The bolts 70 are in turn supported by the upper surface 20 of the mold half 16. It will be readily appreciated that adjustment of bolts 70 will be effective to permit adjustment of the relative vertical position of the gate bar 40 with respect to the spouts 36.

The forwardly extending ends of support arms 44 each define a clevis 62, the clevis 62 receiving a lower end 46*a* of one of the vertical pivotable members 46. The vertical pivotable members are supported by screws 63 which extend through aligned bores 64 in forwardly projecting vertical portions 65 of the support arm 44 and through a horizontal bore 66 in the lower end 46*a* of the vertical pivotable member 46, whereby the members 46 are each pivotable about a horizontal axis.

The gate bar 40 is maintained in sliding relationship against the face of the front wall 28 by cantilevered weight assemblies 80 attached to the upper ends of the vertical members 46. The cantilevered assemblies 80 each include a cantilevered threaded shaft 82 having one end threadably received in a bore 84 in the upper end 46*b* of one of the vertical members 46 and further include a plurality of weights 86 supported on the shaft and adjustably moveable along its length. The shafts 82 each extend rearwardly and the weights 86 are positioned along the shaft 82 so that the cantilevered assemblies 80 cause a torque on the vertical pivotable members 46 biasing the elongated gate bar 40 into engagement with the face of the vertical wall 28. It will be readily appreciated that by adjusting the position of the weights along the length of the threaded shaft 82, the force of the elongated gate bar 40 against the front wall 28 can be varied as desired.

Operation

During the casting operation, when the mold is in a position for receiving molten lead, the ladle will pivot forwardly and downwardly from the position shown in FIG. 4 to the position shown in FIG. 5. The adjustable stop bolt 70 being received against the upper surface of the mold will prevent pivotal movement of the arms 44. Thus, as the ladle 12 continues to pivot about axis A, the elongated gate bar 40 of the ladle gate 38 will slide against the surface 28*a* of the front wall 28, as shown in FIG. 5, uncovering the spouts 36 and facilitating pouring of the molten lead. As the pour or casting operation is completed and the ladle 12 is pivoted about the axis A of shafts 34 back to its original position, the cantilevered weight assemblies 80 will function to prevent movement of the ladle gate 38 with the ladle 12 and will cause the ladle gate to slide downwardly with respect to the planar surface 28*a* of the front wall 28 of the ladle until it again seals the spouts 36. It will be readily noted that the elongated gate bar 40 is maintained in engagement against the surface of front wall 28 of the ladle 12 by the effect of the weights 86 supported by the cantilevered shafts 82.

Alternative Embodiment

Figure 7:
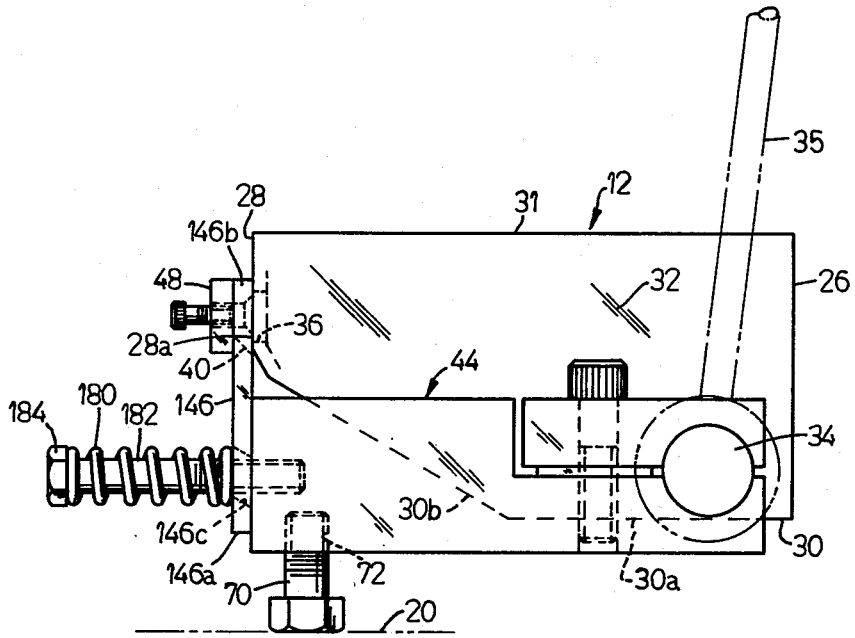
FIG. 7 is a view similar to FIG. 4 but showing a second embodiment of the ladle gate.

FIG. 7 of the drawings illustrates an alternative embodiment of the invention, like the embodiment shown in FIGS. 1–6 except that the elongated gate bar 40 is supported by a pair of vertical arms 146 and the force maintaining the gate bar 40 in sliding engagement against the front wall 28 of the ladle is generated by a pair of coil springs 180.

The support bar 48, supporting the elongated gate bar 40 is supported at each of its opposite ends by the upper ends 146*b* of the vertical arms 146. The lower ends 146*a* of each of the vertical arms 146 include a vertical slot 146*c* therethrough receiving a bolt 182 in turn supported by the end of the arms 44 and extending parallel to the longitudinal direction of the arms 44. The coil springs 180 are each supported by one of the bolts 182 and are compressed between the head 184 of the bolts 182 and the lower portions 146*a* of each of the vertical arms 146.

Figure 8:
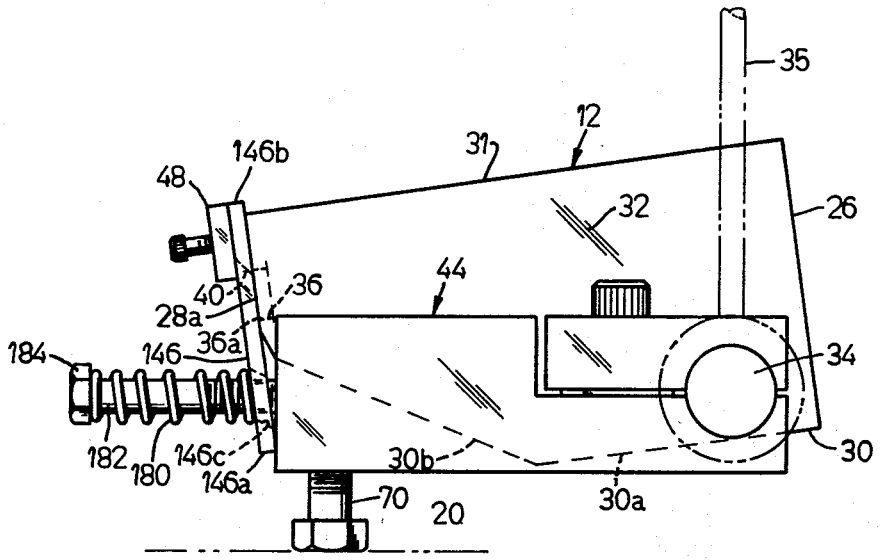
FIG. 8 is a view similar to FIG. 5 but showing the second embodiment of the invention shown in FIG. 7.

In operation, during the pivotal movement of the ladle 12 about the axis A from the position shown in FIG. 7 to the position shown in FIG. 8, the vertical arms 146 are caused to pivot about their lower ends 146*a* and the elongated gate bar 40 slides against the surface of the front wall 28 of the ladle to a relative position, as shown in FIG. 8, to facilitate the flow of molten metal alloy through the spouts 36. At the completion of the casting operation, as the ladle 12 pivots to its original position, the elongated gate bar 40 will slide downwardly relative to the spouts thereby closing the spouts. The gate bar 40 is maintained in contact with the front wall of the ladle by the force of the coil springs 180 acting on the vertical arms 146, and generating a torque on the arms thereby biasing the elongated gate bar 40 into engagement with the ladle front wall.

We claim:

1. A ladle gate for use with casting apparatus and for preventing formation of drippage during casting, the casting apparatus including a mold and a ladle for holding molten metal, the ladle being shiftable between a first position wherein molten metal is poured into said mold and a second position wherein molten metal can be contained in said ladle, said ladle having a front wall including at least one pouring spout therein, the ladle gate comprising:

a bar supported adjacent said front wall and moveable with respect to said spouts between a first ladle gate position to flow preventing position wherein said bar is positioned against said front wall and covers at least a portion of said spout when said ladle shifts from said first position to said second position; and means for supporting said bar against said front wall for movement between said first ladle gate position and said flow preventing position, said means for supporting the bar including a pair of spaced apart vertical arms supporting the bar therebetween, said vertical arms each having opposite ends and being pivotable about a horizontal axis extending through the lower of said ends, and the other of said opposite ends being moveable toward and away from said ladle, and means for biasing said bar against said front wall.

2. The ladle gate set forth in claim 1 wherein said bar is supported against said front wall for slideable movement between said first position and said second position.

3. In combination, casting apparatus comprising:

a mold;

a ladle for containing molten metal, said ladle being supported above said mold and being shiftable between a first position wherein molten metal is contained in said ladle and a pouring position wherein molten metal is poured into said mold, said ladle including at least one spout whereby when said ladle is shifted to said pouring position, molten metal pours through said spout into said mold;

means for supporting said ladle for shiftable movement between said first position and said pouring position and for shifting said ladle from said first position to said pouring position; and means for preventing formation of drippage adjacent said spouts and including a gate bar supported against said wall and shiftable relative to said spout between a first gate bar position when said ladle is in said first position to a second gate bar position when said ladle is in said pouring position, and including means for supporting said gate bar for movement between said first position and said second position, said means for supporting said gate bar including a pair of spaced apart vertical arms each having a lower end supported for pivotable movement about an axis generally parallel to said gate bar and means for supporting said swingable arms for pivotable movement, and means for slideably holding said gate bar against said wall.

4. The apparatus set forth in claim 3 wherein said means for supporting said swingable arms is supported by said mold.

5. The apparatus set forth in claim 3 further including means for biasing said gate bar against said wall, said means for biasing being attached to at least one of said swingable arms.

* * * * *